US006570138B2

(12) United States Patent
Hansen et al.

(10) Patent No.: US 6,570,138 B2
(45) Date of Patent: May 27, 2003

(54) METHOD AND APPARATUS FOR ANTICIPATING RAPID TEMPERATURE FLUCTUATIONS WITHIN AN ENCLOSED HEATED CAVITY

(75) Inventors: William J. Hansen, Brookfield, WI (US); David J. Redanz, Menomonee Falls, WI (US); Michael Lemcke, South Milwaukee, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 205 days.

(21) Appl. No.: 09/784,484

(22) Filed: Feb. 15, 2001

(65) Prior Publication Data

US 2002/0113059 A1 Aug. 22, 2002

(51) Int. Cl.[7] ..... H05B 1/02

(52) U.S. Cl. ..... 219/497; 219/218; 219/413; 219/492; 99/333; 99/468

(58) Field of Search ..... 219/497, 492, 219/494, 501, 506, 218, 413; 392/416; 99/325–333, 468, 476

(56) References Cited

U.S. PATENT DOCUMENTS

| | | | | |
|---|---|---|---|---|
| 4,404,462 A | * | 9/1983 | Murray | 219/497 |
| 4,614,860 A | * | 9/1986 | Kativois | 219/492 |
| 5,025,132 A | * | 6/1991 | Fortmann et al. | 219/401 |
| 5,715,745 A | | 2/1998 | Blanton, Jr. et al. | |
| 5,771,789 A | | 6/1998 | Davis | |

* cited by examiner

*Primary Examiner*—Mark Paschall
(74) *Attorney, Agent, or Firm*—Quarles & Brady LLP

(57) ABSTRACT

A warming chamber defining a heated internal cavity is presented having a door that may be opened or closed to provide access to the cavity for the storage of, for example, food products. The chamber includes a temperature sensor that sends signals to a control regarding the sensed temperature within the cavity. The control then activates heating elements when necessary to maintain the cavity at a predetermined temperature. The control further senses when the door has been opened, and supplies a power boost to the heating elements in anticipation of a cooling effect even though a temperature drop within the cavity has not yet been sensed.

18 Claims, 4 Drawing Sheets

METHOD AND APPARATUS FOR ANTICIPATING RAPID TEMPERATURE FLUCTUATIONS WITHIN AN ENCLOSED HEATED CAVITY

CROSS-REFERENCE TO RELATED APPLICATIONS

STATEMENT REGARDING FEDERALLY SPONSORED RESEARCH OR DEVELOPMENT

BACKGROUND OF THE INVENTION

1. Field of the Invention

The present invention relates generally to warming chambers, and in particular, relates to a method and apparatus for anticipating and correcting for temperature fluctuations due to, for example, opening the door of the chamber.

2. Description of the Related Art

In order to enable restaurants and other food establishments to provide fresh food in bulk, it is necessary to precook the food items and subsequently place them in a warming chamber for preservation before being served. Conventional warming chambers are in widespread use and include an enclosed cavity having a heating element that is operable to direct heat into the chamber. The heating element receives signals from control circuitry operating in conjunction with a temperature sensor, such as a thermostat, to maintain the temperature of the cavity at a desired level. The warming chamber includes a door that is placed at the front end of the warming cavity and that may be opened and closed to provide access to the food products within the chamber. Many such warming chambers include humidity control to maintain the moisture content within the cavity in relation to the equilibrium water activity of the food product, and to further achieve the desired final characteristics of the food product.

Most such warming chambers contain racks within the cavity that support the food products to be heated. However, when the door is opened to either remove or insert the products into the cavity, heated air escapes into the ambient environment and is typically replaced by the cool ambient air. The actual temperature of the chamber is typically measured by a thermostat, which is located toward the back of the chamber so as to avoid being damaged by the products held on these racks or the racks themselves. As a result of the thermostat placement, there is considerable delay before the thermostat senses the heat loss within the warming chamber. The resulting delay in actuating the heating element produces a rapid cooling within the chamber, even after the door is closed, which adversely affects the quality of the food products that are stored therein.

What is therefore needed is a method and apparatus for anticipating and correcting for rapid heat loss in advance that would otherwise occur due to opening the door of a warming chamber.

BRIEF SUMMARY OF THE INVENTION

In accordance with one aspect of the invention, a method for anticipating heat loss in a warming cavity having 1) a door that is disposed at an open end of the cavity and that is movable from a closed position, thereby enclosing the cavity, to an open position, thereby exposing the open end of the cavity, 2) at least one heating element operable to supply heat to the warming cavity so as to maintain the cavity substantially at a set temperature, and 3) a temperature sensor disposed within the cavity at a location remote from the open end, wherein the temperature sensor is operable to measure an actual temperature within the cavity. The method includes automatically determining that the door is open prior to the temperature sensor detecting a drop in the sensed temperature within the cavity, and activating the at least one heating element to heat the cavity towards a target temperature greater than the set temperature.

This and other aspects of the invention are not intended to define the scope of the invention for which purpose claims are provided. In the following description, reference is made to the accompanying drawings, which form a part hereof, and in which there is shown by way of illustration, and not limitation, a preferred embodiment of the invention. Such embodiment does not define the scope of the invention and reference must be made therefore to the claims for this purpose.

BRIEF DESCRIPTION OF THE DRAWINGS

Reference is hereby made to the following figures in which like reference numerals correspond to like elements throughout, and in which.

DETAILED DESCRIPTION OF THE PREFERRED EMBODIMENT

Figure 1:
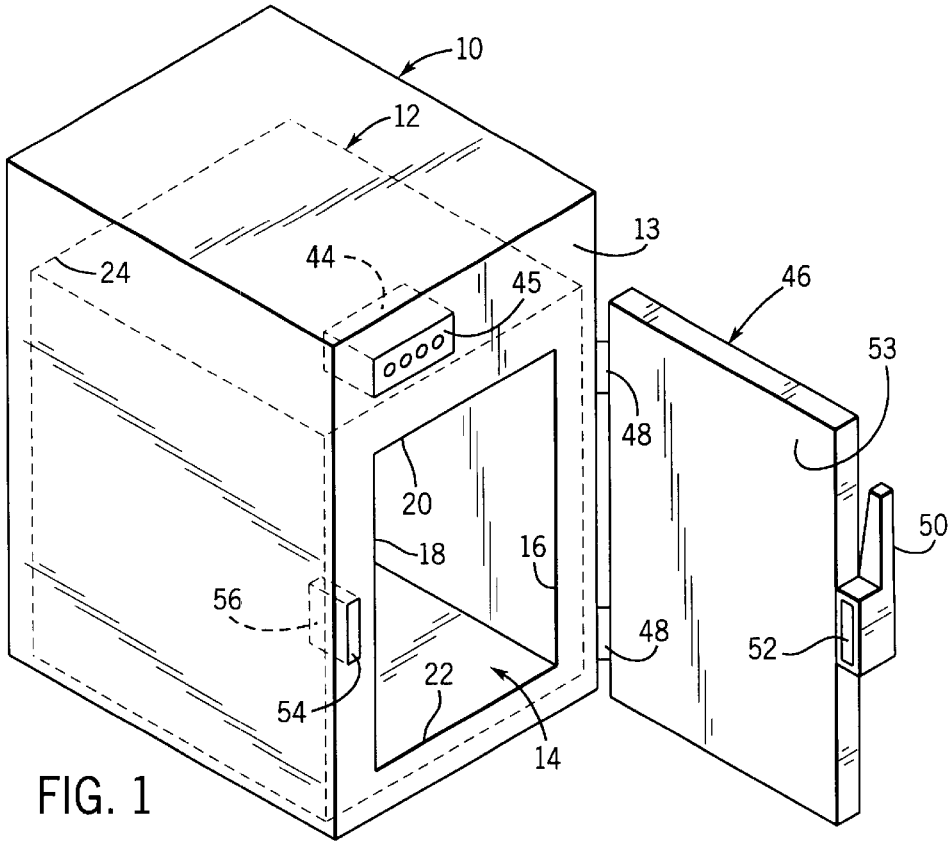
FIG. 1 is a perspective view of a warming cabinet including a warming chamber constructed in accordance with the preferred embodiment.
Figure 2:
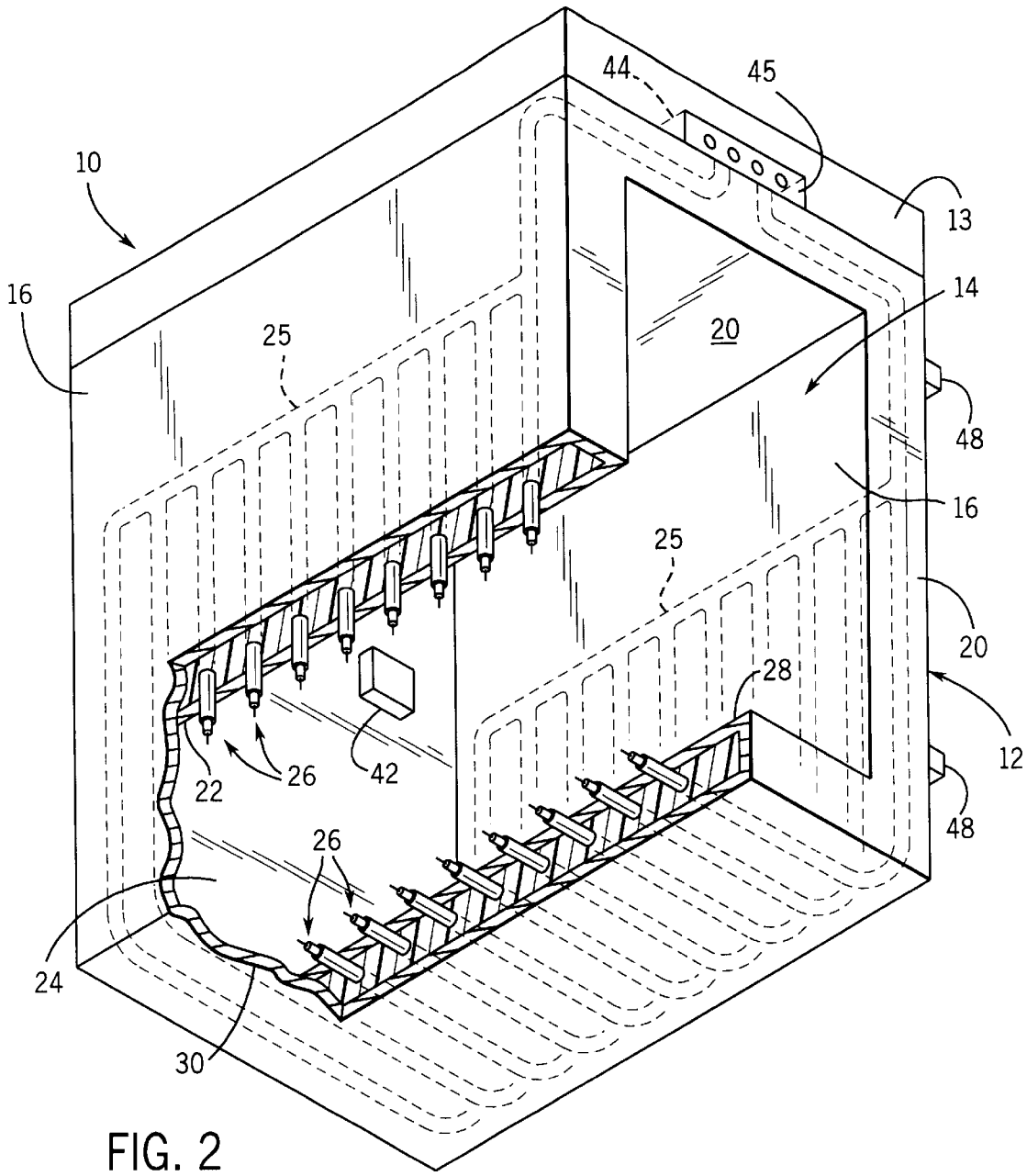
FIG. 2 is a perspective view of the warming chamber illustrated in FIG. 1 having a portion cut away to reveal the heating elements.

Referring initially to FIGS. 1 and 2, a warming cabinet 10 includes a generally rectangular housing that encases a warming cavity 14. Warming chamber 12 is defined by oppositely disposed internal side walls 16 and 18, upper and lower walls 20 and 22, and rear wall 24. Thus, the warming chamber 12 is configured to receive food product therein via, for example, a plurality of food racks (not shown) that maybe supported, for example, by the side walls 16 and 18. If desired, the cabinet 10 may be mounted on appropriate rollers to facilitate its portability.

The cabinet 10 further includes a door 46 that is connected to the cabinet via hinges 48 that allow the door to swivel between an open position to render the cavity 14 accessible to the user, and a closed position to completely enclose the cavity. Door 46 further includes a latch 50 having a magnet 52 disposed on an inner contact surface that mates with a strikeplate 54 to form a door switch 55. The switch forms part of a sensor 56 that is mounted into the front surface 13 of the cabinet 10. Accordingly, when the door is closed, the magnet 52 and strikeplate 54 are in direct contact, which is disrupted upon opening the door 46. As will be described in more detail below, the sensor 56 is connected to control 44 and provides a signal indicating whether the door 46 is open or shut. The door 46 may include an insulating material, or any other suitable material that is capable of minimizing heat loss from the warming cavity 14 when the door is closed. Additionally, the door 46 may include a transparent section so as to reveal the warming chamber 12 to the user when closed.

The warming chamber 12 further includes a temperature sensor 42 that is mounted onto the inner surface of rear wall 24 so as to avoid being damaged by either the food product or accessories disposed within the cavity 14. The temperature sensor comprises a thermostat in accordance with the preferred embodiment. Cabinet 10 further includes a control 44 that is installed having a faceplate 45 generally flush with a front surface 13 of the cabinet 10 above the warming chamber 12 so as to be accessible to a user. For example, several operating parameters for the warming chamber 12 may be selected via knobs and or buttons on the control, such as power, temperature control, and humidity control. As will be described in more detail below, the control 44 will provide a current supply to a heating element 26 when it is determined that the temperature of the warming cavity 14, as indicated by the thermostat 42, is less than the desired temperature indicated by the user on the control 44.

It should be appreciated that conventional warming cavities such as that in accordance with the preferred embodiment are typically configured to introduce moisture into the cavity so as to control the humidity therein. The present invention contemplates such a configuration, and accordingly a reservoir may be attached to the cavity 14 via a conduit having an opening into the cavity (not shown) that is configured to introduce a fluid, such as water, into the cavity at predetermined intervals as is understood by those having ordinary skill in the art.

Referring still to FIG. 2, a plurality of heating elements 26 extend through side and rear walls 16, 18, and 24, respectively, and optionally through bottom wall 22, and are connected to the control 44 via a bus 25. Alternate embodiments may be produced having only one heating element that may comprise a single long heating wire that wraps around the cavity numerous times. The heating elements 26 comprise elongated wires in accordance with the preferred embodiment having a high resistance that produce a significant amount of heat in response to current, as is well known in the art. Accordingly, when elements 26 receive current from the control 44 via a power source (not shown), heat is supplied uniformly to the interior cavity 14. Each wall of the warming chamber 12 comprises a laminate having an inner and outer shell 28 and 30, respectively, that surround an insulation layer 32. The insulation layer 32 may comprise fiberglass sheets, or a suitable alternative insulator, so as to maintain the generated heat within the warming chamber 12. Outer shell 30 encloses warming chamber 12 and provides protection from the ambient environment.

Figure 3:
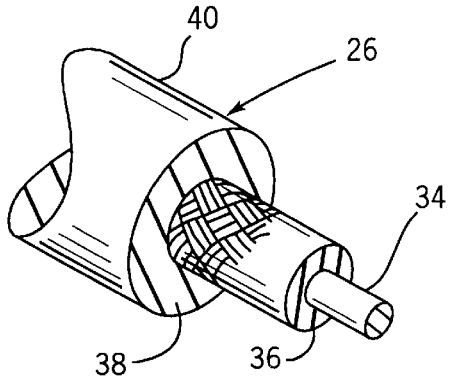
FIG. 3 is a perspective view of a heating element illustrated in FIG. 3.

Referring also to FIG. 3, each heating element 26, in accordance with the preferred embodiment, comprises a high resistance wire 34 surrounded by a silicone rubber sheath 36. The heating element 26 further includes a metallic braid 38 for strength and grounding purposes that is surrounded by an outer silicone rubber jacket 40. A similar warming chamber is described in U.S. Pat. Nos. 3,521,030 and 3,800,123, the disclosures of which are incorporated by reference as if set forth in full herein.

Figure 4:
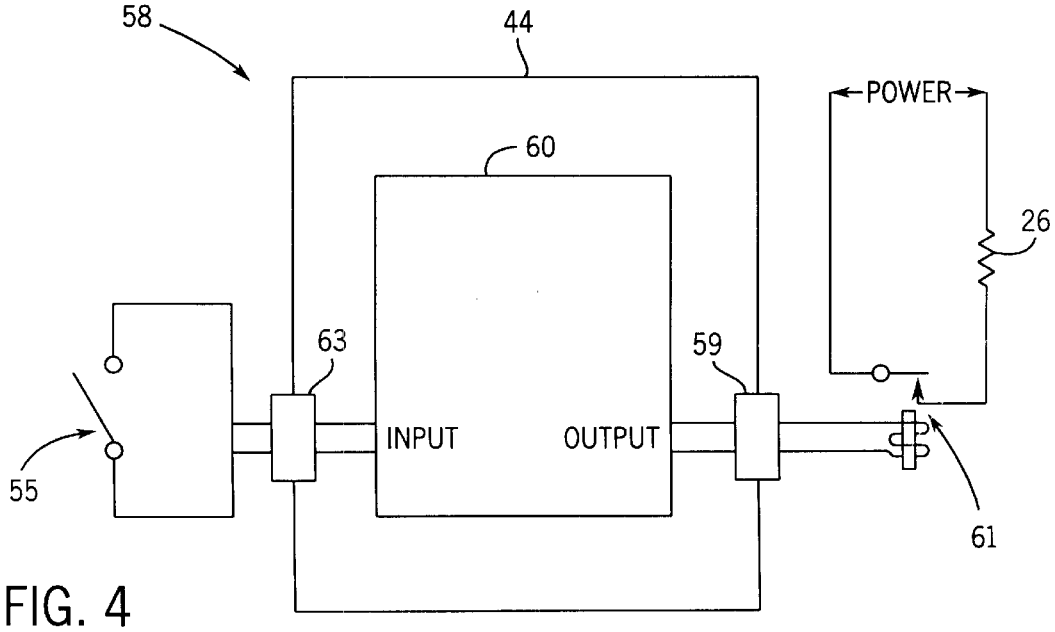
FIG. 4 is a schematic view of the anticipator circuit of the warming chamber illustrated in FIG. 1.

Referring now to FIG. 4, the anticipator circuit 58 constructed in accordance with the preferred embodiment includes the control 44 having a microprocessor 60 disposed therein that receives signals from the door switch 55, via an input 63, that indicate whether the door 46 is open or closed. In response to the status of the door switch 55, the processor 60, under operation of anticipator circuit logic 62, as will be described below, is configured to send control signals via output terminal 59 to a relay 61 which controls the current supply to heating elements 26. It should be appreciated that the anticipator circuit 58 operates concurrently with a closed loop temperature control circuit whereby a temperature sensor 42 sends temperature signals to the microprocessor, which determines whether to activate the heating elements 26 based on a desired temperature, which is entered on the control 44 as a user input. Closed loop temperature circuits of this type are well known and understood to those having ordinary skill in the art. In addition, a door timer is incremented while the door 46 is open, and decremented to a value not less than zero once the door has been closed, as will become more apparent from the description below.

Because the temperature sensor 42 is located in the rear of the chamber 12, the cold ambient air that enters the front of the cavity 14 will not be sensed immediately, and the temperature control circuit will therefore not respond immediately to the temperature drop within the chamber 12. As a result, activation of the heating elements by the control circuit lags behind the cooling of the chamber 12 by an amount of time sufficient to potentially decrease the quality of the food product being stored. Accordingly, the anticipator circuit 58 is configured to activate the heating elements 26 for a predetermined length of time once the door 46 has been opened, as indicated by the door switch 55. Accordingly, when a substantial temperature drop within the warming chamber cavity 14 is expected to occur, the heating elements will be activated before the temperature within the cavity decreases substantially.

Figure 5A:
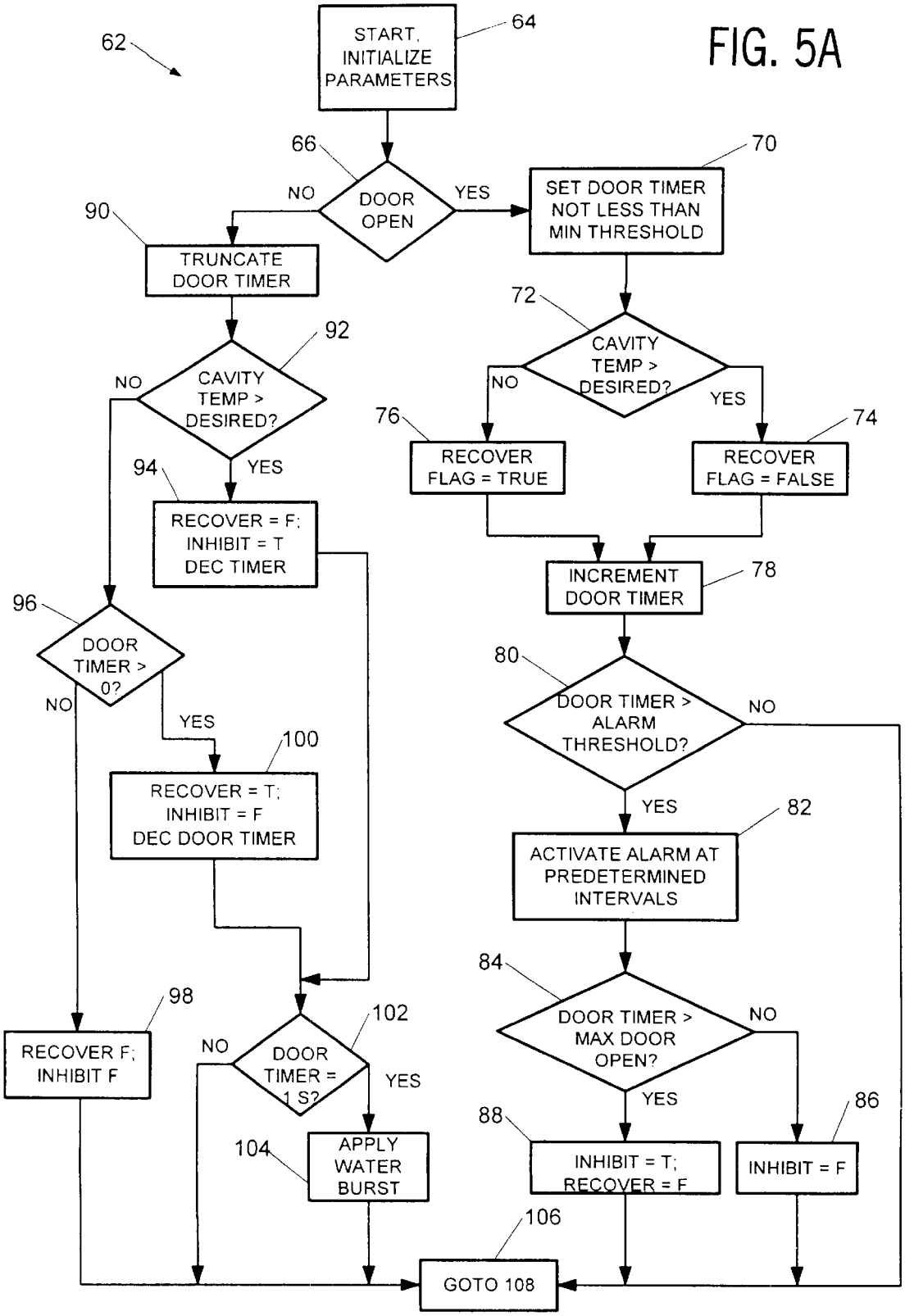
FIG. 5A is a flowchart of anticipator circuit logic performed by the microprocessor of the anticipator circuit illustrated in FIG. 4 in accordance with the preferred embodiment.

Referring now to FIG. 5A, the control operates an anticipator circuitry logic sequence 62, which is performed in conjunction with the closed loop temperature control process, as will now be described. In particular, at step 64 the control 44 is activated, such as by depressing a power switch on the faceplate 45. Typically, an operator will enter a temperature at which to maintain the cavity 14 under normal operating conditions, which as referred to herein as the set temperature. Conventional warming chambers activate the heating elements when it is sensed that the actual temperature within the chamber has fallen below the set temperature. Such conventional warming chambers do not take into account an anticipated heat loss that is not sensed until the temperature within the chamber has dropped to potentially unacceptably low levels. Advantageously, sequence 62 prevents significant temperature drops from occurring within the cavity, as will now be described.

Once the sequence 62 has been activated, it begins at step 64 by initializing the parameters that will be used during subsequent steps, such as a door timer, an INHIBIT flag, and a RECOVER flag, whose respective functions will become apparent from the description below. At decision block 66, it is determined whether the door 46 is open, as indicated by door switch 55. If so, the door timer is examined, and if found to be below a minimum threshold amount, the timer is set to that threshold. Otherwise, the timer is not adjusted. In accordance with the preferred embodiment, the minimum threshold is set to 15 seconds such that the timer will begin accumulating time starting at 15 seconds and not at 0 seconds. In other words, the timer is preloaded with 15 seconds and begins accumulating time immediately starting at 15 seconds. It will become apparent from the description below that, barring a timeout condition, the heating elements will be activated for the length of time indicated by the timer. Accordingly, setting the door timer to 15 seconds at step 70 ensures that the heating elements 26 will be activated for at least 15 seconds once the door is closed. It should be easily appreciated, however, that this minimum threshold may vary depending on the location of temperature sensor 42, and further depending on the difference between the temperature within the cavity 14 and the ambient temperature.

Next, at decision block 72, the measured temperature within the cavity 14 is compared to a desired temperature. In accordance with the preferred embodiment, the desired temperature is selected to equal a predetermined amount greater than the set temperature (Set_Temp+Δ). More particularly, Δ is set to equal 25° F. such that the temperature sensor will indicate that the temperature within the cavity 14 is 25° F. is greater than the set temperature, it being appreciated that the temperature within the cavity is likely less than the temperature indicated by the temperature sensor 42. However, it should be appreciated by those having ordinary skill in the art that Δ could vary based on the threshold amount of time selected for decision block 68, the length of time that the door 46 has been open, the location of the temperature sensor 42 within the cavity 14, and the difference between Set_Temp and the temperature of the ambient environment. This invention further contemplates that the minimum threshold length of time as well as Δ could be determined by the control 44 on a real-time basis taking into account the parameters mentioned above, as would be appreciated by those having ordinary skill in the art.

IF the temperature within cavity 14 has reached the desired temperature, the RECOVER flag is set False at step 74. Otherwise, at step 76, the RECOVER flag is set True, which will cause the heating elements 26 to become activated at subsequent steps, as will become more apparent below. Once the RECOVER flag has been appropriately set, the door timer is incremented at step 78. In particular, the door timer advances by one second increments in accordance with the preferred embodiment.

Next, at decision block 80, the door timer is compared to an alarm threshold length of time. In accordance with the preferred embodiment, the alarm threshold is set to two minutes, such that an alarm will be activated when the door timer advances to predetermined time intervals beyond two minutes. The alarm could comprise either an audible or visible indicator that alerts the user that the door 46 has been open for an extended period of time. In accordance with the preferred embodiment, the alarm is activated every ten seconds once the door timer has exceeded two minutes at step 82.

Sequence 62 then advances to decision block 84, where it is determined whether the door timer has advanced beyond a maximum threshold door open time, which is selected to facilitate the deactivation of heating elements 26 once it has been determined that the door has been open for a maximum length of time. If the door timer exceeds the maximum door open time, the INHIBIT flag is set TRUE at step 88, and the recover flag is set FALSE, thereby ensuring that the heating elements 26 will not activate during the present iteration of sequence 62. Otherwise, if the door timer is less than the maximum door open time, the INHIBIT flag is set False, and the RECOVER flag remains at the state that was set at either step 74 or 76. Sequence 62 then advances to step 106, which in turn, advances to a flag examination sequence 107, which will be described in more detail below.

As a result, once the door timer has reached the maximum door open time, the heating elements 26 will not be activated until it is determined that the door 46 has been closed at decision block 66, as will be described in more detail below. Sequence 62 thus provides a safety feature by overriding a closed loop temperature control process to discontinue current to the heating elements at step 76 when the door has been open an unacceptable length of time. This step additionally conserves energy that would unnecessarily be lost while supplying power to the heating elements 26 unnecessarily. While the maximum door open time is chosen as 10 minutes in accordance with the preferred embodiment, this length of time could differ, as is appreciated by those having ordinary skill in the art. Because the maximum door open time is greater than the alarm threshold time, sequence 62 advances from decision block 80 directly to step 106 if the door timer is less than the alarm threshold.

Once the door is closed, decision block 66 advances to step 90, where the door timer is truncated, if necessary, to a value not greater than a maximum heating time. As described above, once the door 46 is closed, the heating elements 26 are activated for as long as the door was open, as indicated by the door timer. However, it is undesirable to leave the heating elements activated for an extended period of time and, accordingly, if the door timer has exceeded the maximum heating time at step 90, the timer is truncated to equal the maximum heating time. This limits the length of time that the heating elements are activated, once the door 46 is closed, as will become more understood from the description below. The timer is not adjusted at step 90 if it is either equal to or less than the maximum heating time, which equals two minutes in accordance with the preferred embodiment, though it is easily appreciated that this time could differ according to, for example, the desired temperature and the type of food product being heated.

Next, at decision block 92, if the temperature sensor 42 indicates an actual temperature inside the cavity 14 as being greater than the desired temperature, the RECOVER flag is set False and the INHIBIT flag is set True at step 94, thereby ensuring that the heating elements 26 will not be activated during the present iteration. Additionally, at step 94, the timer is decremented by one second. However, the door timer is not decremented if it equals zero. Sequence then proceeds to step 102, as will be described below.

Alternatively, if the temperature within the cavity 14 is not greater than the desired temperature, the door timer is examined at decision block 96 to determine whether it is greater than zero. As stated above, sequence 62 will attempt to heat the cavity 14 to the desired temperature only while the door timer is greater than zero. Once the door 46 has been closed as long as it was open, sequence 62 will maintain the temperature within the cavity 14 at the set temperature. Accordingly, if the door timer is not greater than zero at decision block 96, thereby indicating that the timer equals zero, both the RECOVER and INHIBIT flags are set False at step 98 before proceeding to step 106. If, however, the door timer is greater than zero at decision block 96, the RECOVER flag is set True and the INHIBIT flag is set false at step 100. Additionally, the door timer is decremented by one second, but not less than zero, as described above, before proceeding to decision block 102.

Alternatively, if the temperature within the cavity 14 has not reached the desired temperature, and the door timer is greater than zero, the RECOVER Flag is set True, the INHIBIT Flag is set false, and the door timer is decremented by one second. Next, at decision block 102, if the door timer equals to one second, a burst of water is applied to the cavity 14 from the water reservoir at step 106 to control the humidity within the cavity, as is understood by those having ordinary skill in the art. Otherwise, if the timer has not yet reached one second, sequence advances from decision block 102 to step 106.

Because the temperature within the cavity 14 is only compared to the set temperature only when both the RECOVER and INHIBIT Flags are set False, sequence 62 effectively overrides a conventional control temperature loop by independently activating or deactivating the heating elements 26 whenever the door is either open, or closed less than a predetermined length of time, without comparing the temperature within the cavity 14 to the set temperature entered by the user.

Figure 5B:
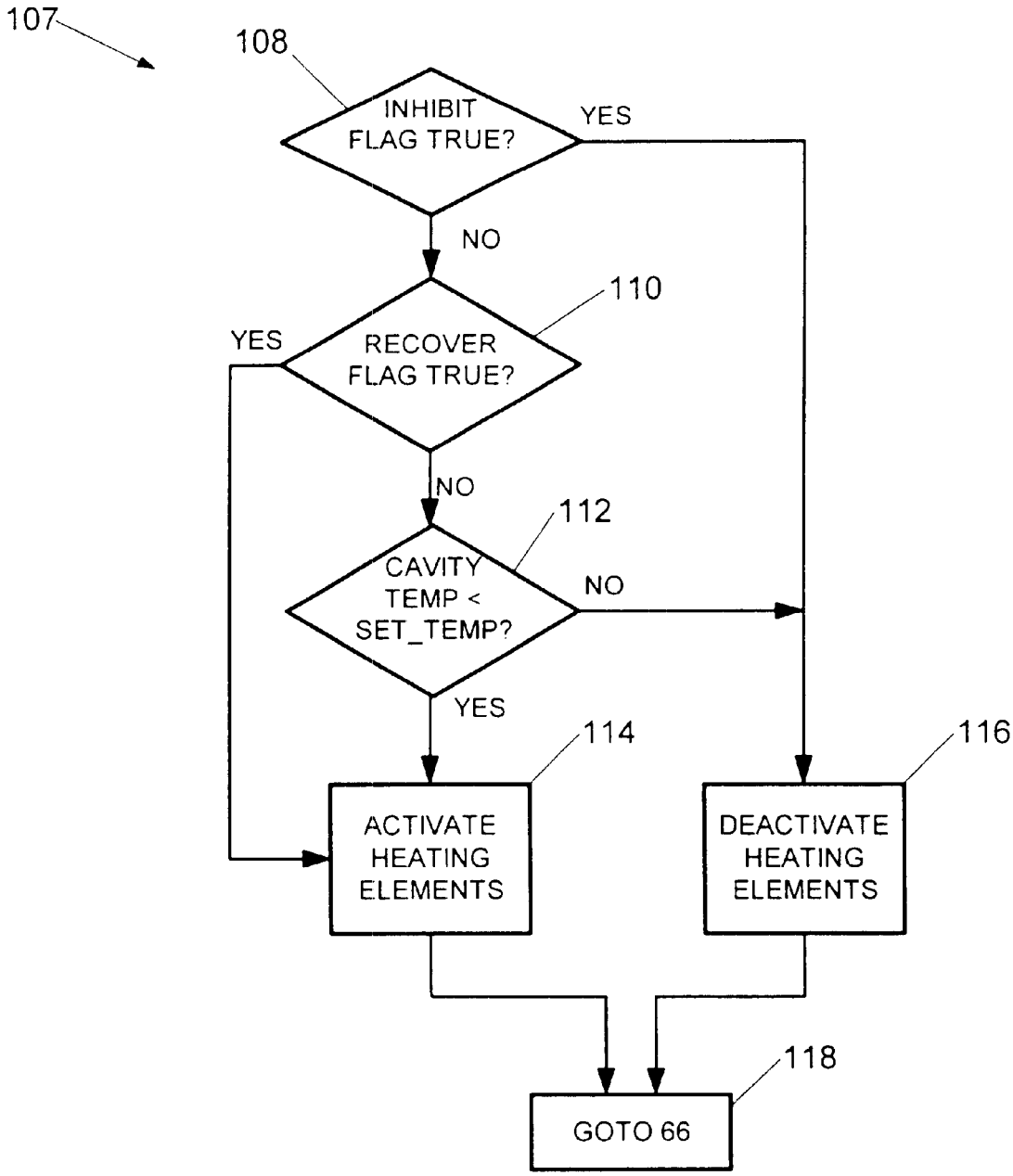
FIG. 5B is a flowchart of the * steps performed by the microprocessor of the anticipator circuit illustrated in FIG. 2** in accordance with the preferred embodiment.

Referring now to FIG. 5B, the flag examination sequence 107 determines whether to activate the heating elements 26 based, at least in part, on the status of the INHIBIT and RECOVER flags. For instance, if the INHIBIT flag is True at decision block 108, the heating elements 26 are deactivated at step 116 regardless of the status of the RECOVER flag, and regardless of the temperature within the cavity 14. As discussed above, the INHIBIT flag is set True when the door 46 is open, and the door timer has exceeded the maximum door open time. Additionally, the INHIBIT flag is set True when the door 46 is closed, and the temperature within the cavity has reached the desired temperature.

Otherwise, if the INHIBIT Flag is false at decision block 108, sequence 107 proceeds to decision block 110, where the RECOVER Flag is examined. In particular, the heating elements 26 are activated if the RECOVER Flag is True. As discussed above, the RECOVER Flag is set True when the door 46 is open and the temperature within cavity 14 has not reached the desired temperature, assuming that the door timer has not reached the maximum door open time. Additionally, the RECOVER Flag is set true when the door 46 is closed, and the temperature within cavity 14 has not reached the desired temperature, and the door timer is greater than zero. As a result, when the door 46 is opened, the heating elements are activated until the temperature sensor 42 indicates an actual temperature within the cavity 14 equal to the desired temperature, assuming that the door is not open longer than the maximum permissible amount of time. Once the door is closed, the heating elements will be activated until either the temperature within the cavity 14 is sensed to equal the desired temperature, or the door timer expires.

If the RECOVER flag is False at decision block 110, the temperature indicated by temperature sensor 42 is compared to the set temperature at decision block 112. For example, when the door 46 is closed, and the door timer has expired, both the INHIBIT and RECOVER flags are set False, which causes sequence 107 to only activate the heating elements when the indicated temperature within the cavity 114 has fallen below the set temperature. Once the heating elements 26 have either been activated or deactivated at step 114 or 116, respectively, sequence 107 reverts to decision block 66, as described above.

The invention has been described in connection with what are presently considered to be the most practical and preferred embodiments. However, the present invention has been presented by way of illustration and is not intended to be limited to the disclosed embodiments. For example, while the invention has been illustrated as being implemented in combination with a warming chamber that operates at approximately 150° Fahrenheit in accordance with the preferred embodiment, it should be easily appreciated that the principle of controlling heat supplied to a heated cavity based on an anticipated heat loss could apply to any type of cavity, such as a conventional oven that reaches significantly higher temperatures, for example approximately 500° Fahrenheit or greater. Accordingly, those skilled in the art will realize that the invention is intended to encompass all modifications and alternative arrangements included within the spirit and scope of the invention, as set forth by the appended claims.

I claim:

1. A method for anticipating heat loss in a warming cavity having 1) a door that is disposed at an open end of the cavity and that is movable from a closed position to an open position, 2) at least one heating element operable to supply heat to the warming cavity so as to maintain the cavity substantially at a set temperature, and 3) a temperature sensor disposed within the cavity at a location remote from the open end, wherein the temperature sensor is operable to measure a sensed temperature within the cavity, the steps comprising:

(a) automatically determining that the door is open prior to the temperature sensor detecting a significant drop in the sensed temperature within the cavity; and (b) activating the at least one heating element to heat the cavity towards a target temperature greater than the set temperature.

2. The method as recited in claim 1, further comprising:

(c) de-activating the at least one heating element when the temperature sensor indicates a sensed temperature greater than the target temperature.

3. The method as recited in claim 2, further comprising:

(d) incrementing a timer while the door is open.

4. The method as recited in claim 3, further comprising:

(e) de-activating the at least one heating element when the timer exceeds a predetermined maximum threshold.

5. The method as recited in claim 3, further comprising:

(e) automatically detecting that the door has been closed;

(f) decrementing the timer; and (g) controlling the at least one heating element to maintain the sensed temperature substantially at the set temperature once the timer has expired.

6. The method as recited in claim 5, further comprising truncating the timer to activate the heating elements no greater than a predetermined maximum length of time when the door is closed.

7. The method as recited in claim 5, further comprising delivering water vapor to the cavity once the timer has substantially expired and the door is closed.

8. The method as recited in claim 1, further comprising activating an alarm at predetermined time intervals indicating that the door has been open for an extended period of time.

9. A warming cabinet comprising:

a housing defining a warming chamber therein and having a door that is movable between a closed position and an open position;

a door sensor operable to determine whether the door is in the closed and the open position;

a temperature sensor providing output indicating an actual temperature of the warming chamber;

a heating element operable to receive power and supply heat to the chamber when the actual temperature is less than a desired temperature; and a control in communication with the temperature sensor and the door sensor, and operable to control the heating element so as to maintain the actual temperature at a set temperature, wherein the control further supplies power to the heating element in response to the door being opened before the temperature sensor indicates that a substantial temperature drop within the chamber has occurred.

10. The warming cabinet as recited in claim 9, wherein the temperature sensor is disposed within the cavity at a remote location with respect to the door.

11. The warming cabinet as recited in claim 9, further comprising a timer that is coupled to the control and that increments when the door is open, and decrements when the door is closed.

12. The warming cabinet as recited in claim 11, wherein the control discontinues power from the heating element when the door has been in the open position for a maximum amount of time.

13. The warming cabinet as recited in claim 12, further comprising an alarm operable to indicate that the door has been open for a predetermined extended length of time.

14. The warming chamber as recited in claim 13, wherein the control discontinues power from the heating elements when the actual temperature has reached a predetermined amount greater than the set temperature.

15. The warming chamber as recited in claim 13, wherein the control is operable to maintain the temperature within the cavity at the set temperature when the door is closed and the timer is expired.

16. A warming cabinet configured to maintain a warming chamber substantially at a desired temperature, comprising:

a housing defining a warming chamber therein including a door that is movable between a closed position and an open position;

a temperature sensor operable to measure an actual temperature inside the warming chamber;

a heating element operable to supply heat to the chamber;

heater control circuitry including a control operable to activate the heating elements when the actual temperature is less than the desired temperature; and anticipator circuitry operable to override the heater control circuitry and activate the heating element when the door is open.

17. The warming cabinet as recited in claim 16, wherein the anticipator circuitry deactivates the heating element when it is determined that the door has been open for a predetermined maximum amount of time.

18. The warming cabinet as recited in claim 16, further comprising a magnet disposed on the door and a strike plate disposed on the housing and in contact with the magnet when the door is closed, and separated from the magnet when the door is open.

* * * * *